US007644454B2

(12) United States Patent
Lukasiak

(10) Patent No.: US 7,644,454 B2
(45) Date of Patent: Jan. 12, 2010

(54) MECHANICAL LIFTING SYSTEM

(75) Inventor: Zbignlew Lukasiak, Aleksandrow Lodzki (PL)

(73) Assignee: Alreh Medical SP. Z.O., Warszawa (PL)

( * ) Notice: Subject to any disclaimer, the term of this patent is extended or adjusted under 35 U.S.C. 154(b) by 0 days.

(21) Appl. No.: 12/190,705

(22) Filed: Aug. 13, 2008

(65) Prior Publication Data

US 2009/0126104 A1 May 21, 2009

(51) Int. Cl.
*A61G 7/10* (2006.01)

(52) U.S. Cl. ..... 5/83.1; 5/86.1

(58) Field of Classification Search ..... 5/83.1, 5/81.1 R, 86.1, 87.1, 89.1, 81.1
See application file for complete search history.

(56) References Cited

U.S. PATENT DOCUMENTS 6,806,430 B2 * 10/2004 Downing ..... 177/144

* cited by examiner

*Primary Examiner*—Fredrick Conley
(74) *Attorney, Agent, or Firm*—Katten Muchin Rosenman LLP

(57) ABSTRACT

The subject of the invention is a mechanical lifting system with seat which enable the disabled people with paralysis or paresis of lower limps to stand up from the wheelchair and without excessive energy expenditure take upright position in standing frame and came back to the wheelchair. This mechanical lifting system can be used in a kind of walking frame, static standing frame or mobile standing frame and is very useful in rehabilitation of disabled people.

4 Claims, 3 Drawing Sheets

MECHANICAL LIFTING SYSTEM

Figure 1:
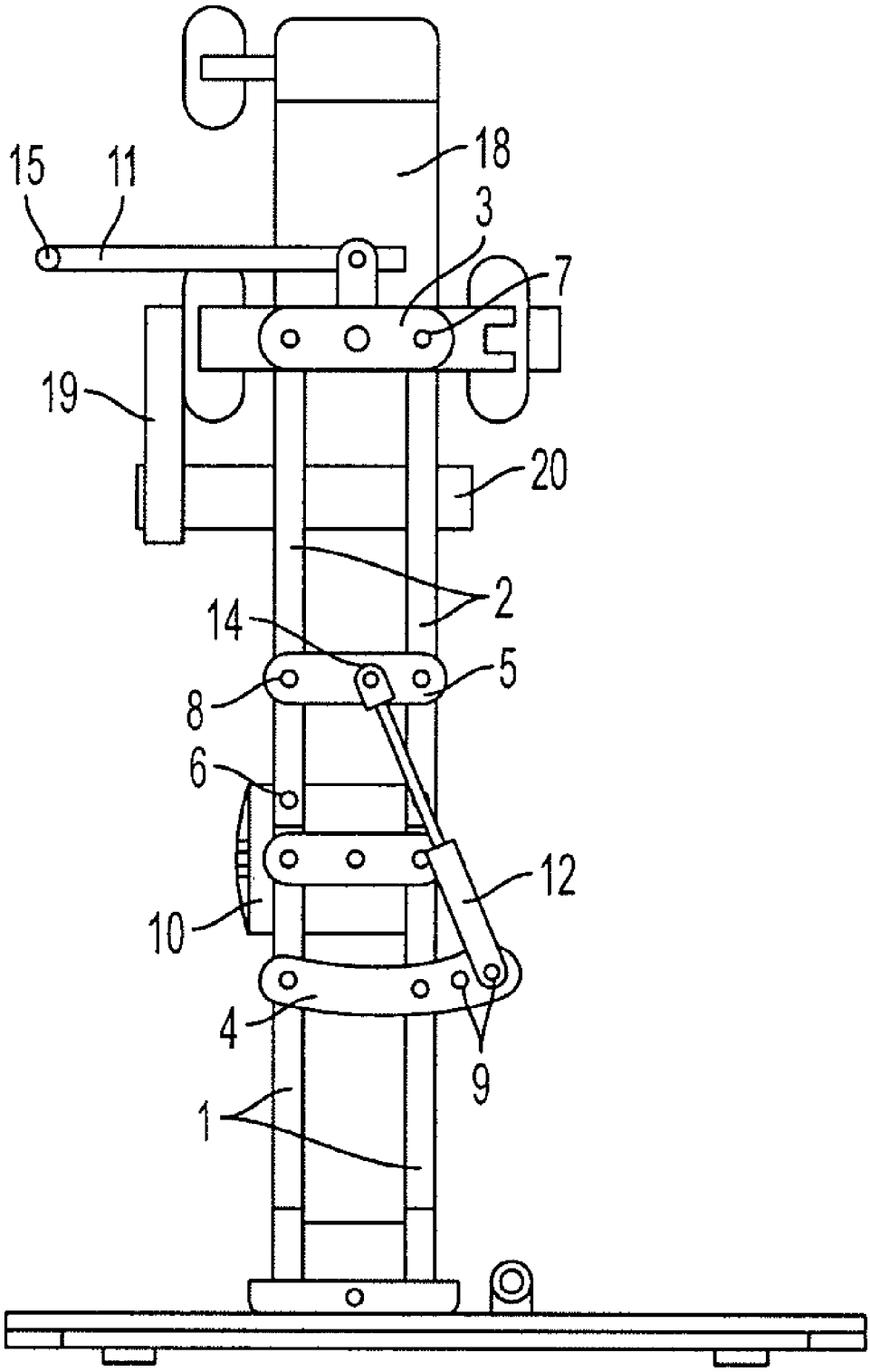

The subject of the invention is a mechanical lifting system with seat which enable the disabled people with paralysis or paresis of lower limps to stand up from the wheelchair and without excessive energy expenditure take upright position in standing frame and came back to the wheelchair.

This mechanical lifting system can be used in a kind of walking frame, static standing frame or mobile standing frame and is very useful in rehabilitation of disabled people.

In the description No. 172285 "Hoist for disabled persons" there is described a device in which the cabin is linked with dead weights by means of ropes passing through upper gear wheel and which is equipped with manual drive consisting of gear transmissions. In the description No. 174281 there is described "Rehabilitation table bringing to upright position" which has a bottom frame, rectangular in sectional view, fixed in travel wheels. Four support posts and electromagnetic servo-motor are mounted in this frame. Such solution has belts to fasten a patient to upholstered plate.

The idea of the invention is that the vertical side support unit consists of two segments—bottom segment and top segment, the bottom segment consists of at least one vertical element while top segment consists of at least two vertical elements and vertical elements of the top segment are connected in bottom part by a swivel joint with the bottom segment while in the top part they are connected by swivel joint with connector but to the top segment below the connector one end of gas spring, electric spring or hydraulic actuator is fixed while the other end is fixed to the bottom segment of side support unit below the fixing place of knee support. To the hand handle close to the thumb of a disabled persona control system is mounted on the handle in form of a pushbutton or lever to release gas/oil spring, electric spring or hydraulic actuator. Furthermore to a pair of connectors a corset is mounted, to the front wall of which a seat consisting of at least vertical segment and horizontal segment is fixed in such a way that the vertical segment is fixed to the corset front and horizontal segment is directed towards the opened rear part of the corset.

The single lifting set consists of a vertical side support unit, connectors, knee support, hand handle, working element in form of gas spring, electric spring or hydraulic actuators and control system. Vertical side support unit consists of two segments: bottom segment and top segment. Bottom segment consists of at least one vertical element mounted to a lever connected by a swivel joint with a runner in case of dynamic walking frames or directly to the base in case of static standing frames or mobile standing frames. Top segment consists of at least two vertical elements; the ends of vertical elements of top segment are connected with the elements of the bottom segment by means of a swivel joints while the first connector, which is also a corset holder, is connected by means of articulated joints with other ends of vertical elements. Joints, by means of which vertical elements of the top segment are connected with vertical elements of the bottom segment, and joints, by means of which vertical elements of the top segment are connected with the first connector, make a parallelogram. To the bottom segment of the vertical side support, slightly below the joints connecting bottom segment with the top segment, there is mounted a knee support for supporting knee or shank of disabled person during taking upright position, standing or walking in upright position as well as returning from upright to seating position. Below the knee support, the second connector is mounted to the bottom segment of vertical side support. The connector has minimum one fixing point to which one end of gas spring, electric spring or hydraulic actuator is mounted. The second end of gas spring, electric spring or hydraulic actuator is fixed to the third connector mounted by articulated joint to the top segment of vertical side support or directly to the first connector. Joints of the third connector together with the joints, by means of which vertical elements of upper segment are connected with vertical elements of bottom segment, as well as joints, by means of which vertical elements of top segment are connected with the first connector, make parallelograms.

To the first connector a hand handle is mounted which enable to support the upper part of the trunk of a disabled person during taking upright position, standing and seating. Additionally hand handle enable to walk forward, backwards and turn round the vertical axis. Each hand handle in the front part is equipped with a palm handle to which close to the thumb of a disabled person a control/release system of gas spring, electric spring or hydraulic actuator is mounted.

To the two sets of the mechanical lifting system a special corset is fixed, opened in its rear part used for support of pelvis and upper part of trunk of a disabled person. Corset may be suspended on a swivel joint with a limited rotation angle forward and backward (application in dynamic walking frames) or stiff connection (used in some static standing frames or mobile standing frames). To the corset there is mounted a seat consisting of at least two segments: vertical and horizontal segment. The vertical segment is mounted to the front part of the corset while the horizontal segment, which is a proper seat used for seating and/or supporting a crotch of a disabled person, is directed toward the opened rear part of the corset. The length of the vertical segment may be controlled, which results in the change of the height of horizontal segment in relation to the corset; the vertical segment may consist of one element or a few elements operating in a parallel or parallel-series system. Horizontal segment which is a proper seat may have a constant length or may be made of several elements dislocated (sliding out) in relation to each other. Additionally horizontal segment may be made of a pair of units connected at one end with the vertical segment by articulated joint in such a way that a pair of units of the horizontal segment may form arms of an acute angle directed towards opened rear part of the corset. Each unit of the horizontal segment may have a constant length or may be made of several elements dislocated (sliding out) in relation to each other.

To the bottom part of vertical side support units a lever connected by a swivel joint with a runner in case of dynamic walking frames or the base of static standing frames or mobile standing frame may be fixed. The invented mechanical lifting system used in the walking frame or static/mobile standing frame allows, by squeezing and locking the springs, the inclination of the upper segments of vertical side supports backwards, lowering the corset position, which in turn makes it possible for a disabled person to place his pelvis and trunk in it and to move from a wheelchair to a seat mounted to the corset front part. Upper segments of vertical side support units are inclined backward, corset in horizontal position or close to horizontal position is at the height of pelvis of a disabled person, seat is in the horizontal position at the height of wheelchair seat. Springs are squeezed and locked.

A disabled person on a wheelchair gets closer to the rear part of the device, opens the rear part of the corset, blocks the wheelchair brakes, places the feet on the platforms on the runners or base of the standing frame, places knee into knee supports, moves the body to wheelchair edge, grasps the hand handles with both hands, moves the body from wheelchair seat onto horizontal segment of the seat (proper seat), supports the upper parts of arms on trunk side supports which are in a corset, activates by means of a pushbutton or lever a control system of springs or actuators. Springs activate straightening up of upper segments of vertical side supports which lift the corset with a disabled person upward maintaining its horizontal position. After reaching an upright position a disabled person releases the pushbutton or lever of control system and thus locks the lifting system and closes the corset. To a three point support of a disabled person body i.e. heel—knee (patella area)—hip belt a crotch support was added, which increases safety and comfort in upright position. Return on the wheelchair requires the above mentioned operations made in the reverse order.

Figure 2:
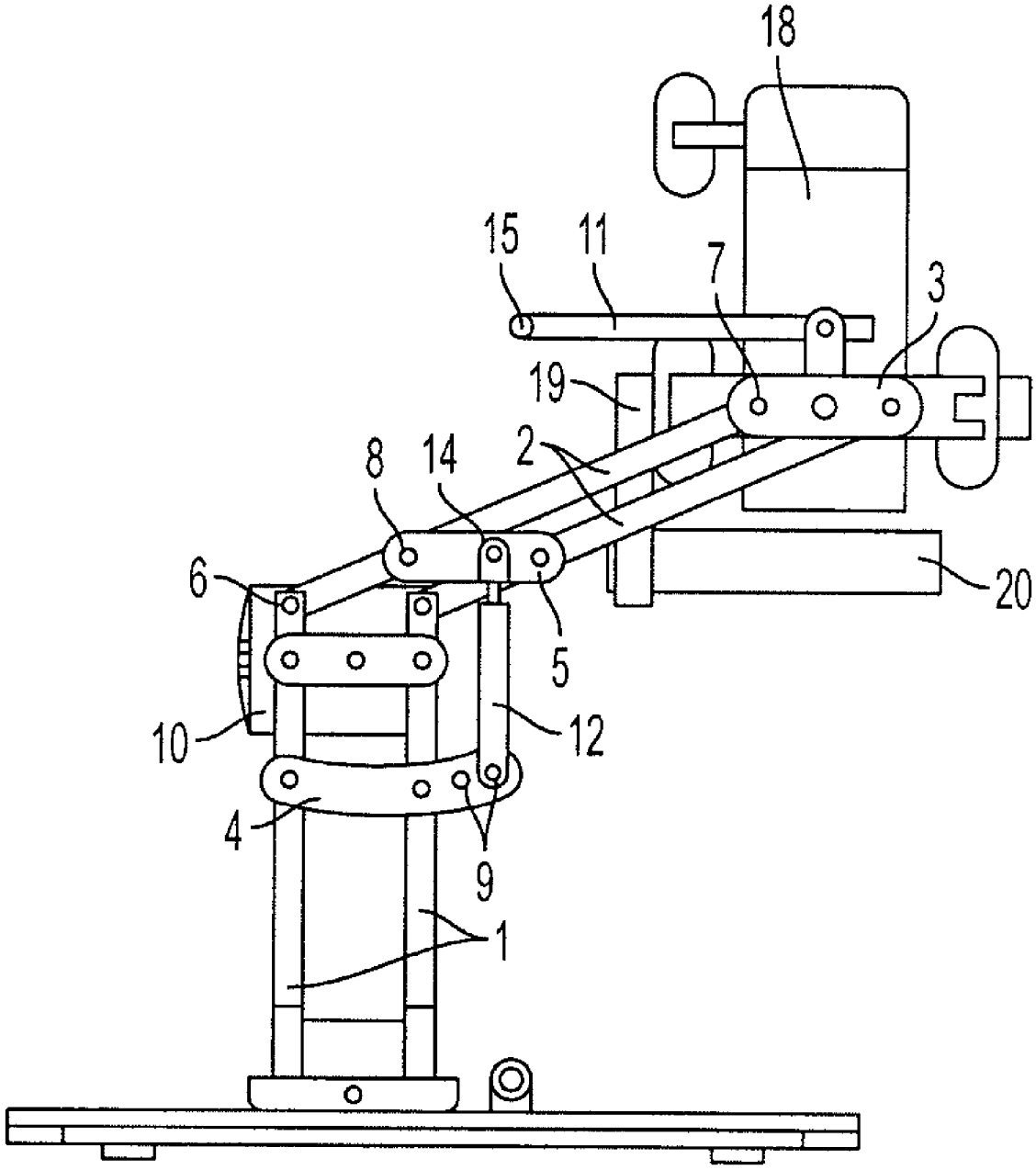
Figure 3:
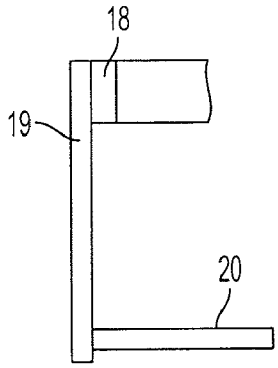
Figure 4:
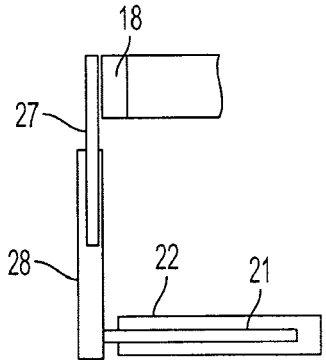
Figure 5:
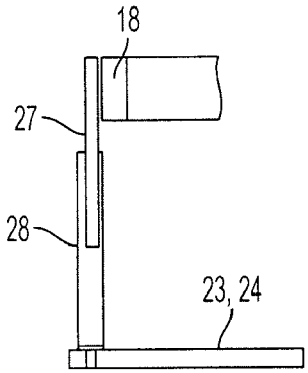
Figure 6:
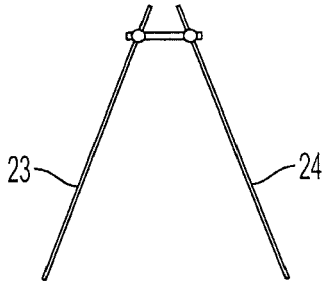
Figure 7:
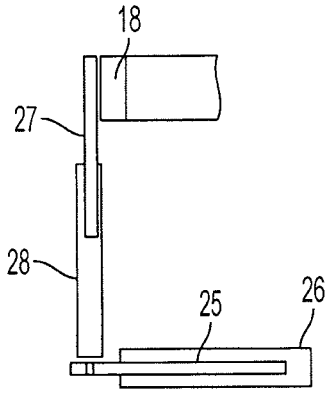

The subject of the invention is shown as an example in FIG. 1-7, where:

FIG. 1 presents the mechanical lifting system with seat in upright position in side view;

FIG. 2 presents the mechanical lifting system with seat in folded and locked position in side view;

FIG. 3 presents schematic seat with vertical and horizontal segment of constant length mounted to the front part of a corset in side view;

FIG. 4 presents schematic seat with horizontal segment of variable length in side view;

FIG. 5 presents schematic seat with units of horizontal segment mounted by means of a swivel joint to vertical segment in side view;

FIG. 6 presents schematic seat with units of horizontal segment mounted by means of a swivel joint to vertical segment in top view;

FIG. 7 presents schematic seat with units of horizontal segment of variable length mounted to vertical segment in side view.

The mechanical lifting system with seat which enable the disabled people with paralysis or paresis of lower limps to stand up from the wheelchair and without excessive energy expenditure take upright position in standing frame and came back to the wheelchair was shown as an example applied in dynamic walking frame and includes two lifting sets operating in parallel system, activated by means of one control system or two independent systems which activate each set independently, corset and seat.

The single lifting set is made of vertical side support units (1) and (2), three connectors (3), (4) and (5), joints (6), (7) and (8), knee support (10), hand handle (11), working element (12) in form of gas spring, electric spring or hydraulic actuator, control system of working element (13) connected with each other. Vertical side support unit consists of two segments—bottom segment (1) and top segment (2). The bottom segment (1) consists of at least of one vertical element mounted to a lever connected by a swivel joint with a runner in case of dynamic walking frame or directly to the base in case of static/mobile standing frame. The top segment (2) consists of at least two vertical elements and the ends of vertical elements of the top segment are connected by means of articulated joints (6) with the elements of the bottom segment while the first connector (3), which functions also as the corset handle, is fixed to other ends by means of articulated joints (7). Joints (6) connecting vertical elements of the top segment (2) with vertical elements of the bottom segment (1) and joints (7) connecting vertical elements of the top segment (2) with the first connector (3) make a parallelogram. To the bottom segment (1) of vertical side support, slightly below the joints (6) connecting the bottom segment with the top segment, there is mounted a knee support (10) used for knee support during taking an upright position, standing or walking in upright position as well as returning from upright position to seating position. Below the knee support (10) to the bottom segment (1) of the vertical side support the second connector (4) is fixed having at least one fixing point (9) to which one end of gas spring (12), electric spring or hydraulic actuator is fixed. The other end of gas spring (12), electric spring or hydraulic actuator is fixed to the third connector (5) mounted by means of articulated joints (8) to the top segment (2) of vertical side support. The articulated joints (8) of this connector together with joints (6) by means of which vertical elements of the top segment are connected with the vertical elements of the bottom segment and joints (7) by means of which vertical elements of the top segment are connected with the first connector make parallelograms. To the first connector (3) there is mounted a hand handle (11) for supporting by hands the upper part of the trunk of a disabled person while taking upright position, coming back on wheelchair, standing or walking and for maneuvering of the device during walking. The hand handle (11) in the front part is equipped with a palm handle (15) to which close to the thumb of a disabled person there is mounted a control system (13) of gas spring, electric spring or hydraulic actuator.

Example of the Seat I:

To a pair of connectors (3) a corset (18) is mounted and to the front wall of the corset a seat consisting of a vertical segment (19) and horizontal segment (20) which is a proper seat is fixed. The upper part of the segment (19) is fixed to the front part of the corset (18), while to the bottom part of the segment (19) the horizontal proper seat (20) is fixed.

Example of the Seat II:

To a pair of connectors (3) a corset (18) is mounted and to the front wall of the corset a seat including a vertical segment which consists of the upper element (27) and bottom element (28), guide (21) and slide sleeve (22) is fixed. The upper element (27) is fixed to the front part of the corset (18), while the bottom element (28) is mounted in a sliding way (telescopic way) to the upper element (27). To the bottom element (28) a horizontal guide (21) is fixed along which a slide sleeve (22) which is used as a proper seat moves forward and backward.

Example of the Seat III:

To a pair of connectors (3) a corset (18) is mounted and to the front wall of the corset a seat including a vertical segment which consists of the upper element (27) and bottom element (28), guide (21) and slide sleeve (22) is fixed. The upper element (27) is fixed to the front part of the corset (18), while the bottom element (28) is mounted in a sliding way (telescopic way) to the upper element (27). To the bottom element (28) units (23) and (24) which are used as a proper seat are mounted by articulated joints.

Example of the Seat IV:

To a pair of connectors (3) a corset (18) is mounted and to the front wall of the corset a seat including a vertical segment which consists of the upper element (27) and bottom element (28), horizontal guides (25) and slide sleeves (26) is fixed. The upper element (27) is fixed to the front part of the corset (18), while the bottom element (28) is mounted in a sliding way (telescopic way) to the upper element (27). To the bottom element (28) a horizontal guides (25) are fixed by articulated joints. Along the guides (25) the slide sleeves (26) which are used as a proper seat move forward and backward.

The above examples do not limit the invention

The invention claimed is:

1. A mechanical lifting system for lifting a person from a sitting position to an upright position, comprising:

a seat;

a standing frame including a pair of lifting sets working in parallel and activated by a control system, wherein each of the pair of lifting sets includes:

a vertical side support unit, a plurality of connectors, a knee support, a hand handle, a working element formed of a gas spring, an electric spring or a hydraulic actuator, and a control system for controlling the working element, wherein the vertical side support includes a bottom segment and a top segment, the bottom segment includes a vertical element, the top segment includes two parallel elements connected at a lower portion by a first swivel joint with an upper portion of the bottom segment, an upper portion of the top segment is connected by a second swivel joint with a connector of the plurality of connectors, one end of the working element is fixed to the top segment in a position below the connector, and another end of the working element is fixed to the bottom segment at a position below a fixing place of the knee support.

2. The mechanical lifting system according to claim 1, wherein the control system is mounted in a portion of the hand handle adjacent to a thumb of the person in the form of a pushbutton or lever adapted to release the working element.

3. The mechanical lifting system according to claim 2, wherein a corset is mounted to the connector, the seat includes a vertical segment and a horizontal segment, and the vertical segment is fixed to a front portion of the corset and the horizontal segment is directed towards an opened rear portion of the corset.

4. The mechanical lifting system according to claim 1, wherein a corset is mounted to the connector, the seat includes a vertical segment and a horizontal segment, and the vertical segment is fixed to a front portion of the corset and the horizontal segment is directed towards an opened rear portion of the corset.

* * * * *